US009725852B1

(12) United States Patent
Kelyman

(10) Patent No.: US 9,725,852 B1
(45) Date of Patent: Aug. 8, 2017

(54) PNEUMATIC DUST HOOD WITH PLUG PREVENTER

(71) Applicant: Brunn Air Systems, Inc., Memphis, TN (US)

(72) Inventor: John Kelyman, Memphis, TN (US)

(73) Assignee: Brunn Air Systems, Inc., Memphis, TN (US)

( * ) Notice: Subject to any disclaimer, the term of this patent is extended or adjusted under 35 U.S.C. 154(b) by 0 days.

(21) Appl. No.: 15/276,684

(22) Filed: Sep. 26, 2016

Related U.S. Application Data

(60) Provisional application No. 62/234,061, filed on Sep. 29, 2015.

(51) Int. Cl.
*D21G 9/00* (2006.01)

(52) U.S. Cl.
CPC ..... *D21G 9/00* (2013.01)

(58) Field of Classification Search
CPC ..... A47L 5/38; A47L 9/0063; A47L 9/244; D01H 11/005; B23G 11/0046; B08B 15/002; B08B 15/023; B08B 15/026
See application file for complete search history.

(56) References Cited

U.S. PATENT DOCUMENTS 4,875,054 A * 10/1989 Archer ..... B41J 2/20 239/298
6,017,416 A * 1/2000 Judd ..... D21C 9/06 162/60
8,118,942 B2 * 2/2012 Featherson ..... B08B 5/026 134/15

* cited by examiner

*Primary Examiner* — Dung Van Nguyen
(74) *Attorney, Agent, or Firm* — PatentBest; Andrew McAleavey

(57) ABSTRACT

A pneumatic hood for a tissue—or papermaking machine is disclosed. The hood has an inlet to admit dust and air. The inlet is defined, in part, by an inlet flap that is hingedly connected to the body of the hood. The inlet flap is connected to one or more linear actuators, such as pneumatic cylinders, by a linkage such that the linear actuators drive the inlet flap between positions in which the inlet is wider and positions in which the inlet is narrower. Thus, the size of the inlet can be increased to clear large obstructions.

18 Claims, 4 Drawing Sheets

PNEUMATIC DUST HOOD WITH PLUG PREVENTER

CROSS-REFERENCE TO RELATED APPLICATIONS

This application claims priority to U.S. Provisional Patent Application No. 62/234,061, filed Sep. 29, 2015. The contents of that application are incorporated by reference in their entirety.

BACKGROUND OF THE INVENTION

1. Field of the Invention

In general, the invention relates to pneumatic dust hoods, and more specifically to pneumatic hoods for capturing dust in paper and tissue manufacturing processes.

2. Description of Related Art

Modern industrial tissue-making processes are typically performed using a single machine. On the "wet" side of the machine, a combination of plant fibers, typically some combination of virgin and recycled wood pulp is formed by pressing between a wire mesh and a felt as it wraps around a forming roll. The wet web is transferred to a large-diameter drying cylinder, called a yankee cylinder, and is peeled from the yankee cylinder by a scraping blade, called a doctor blade. As the web winds through the "dry" side of the machine, it passes through a maze of turns, is calendered (i.e., softened by compressing the web) and may go through a slitting process before being wound into a final roll, called a parent roll. The tissue on the parent roll may be further processed, depending on the product that is being made.

Tissue-making machines are often very large—the machine itself may be 5.7 or 2.4 meters wide with a tissue web very nearly that wide—and operate at very high speeds, e.g., of up to 2,000 meters per minute. The speed of the machine and the volume of paper that passes through in a short period of time create a large volume of paper particles and dust. The dust is a health hazard for workers, and if it builds up enough, it can also be an explosion hazard. Beyond that, accumulated dust and paper can impede the web of tissue and require the machine to be shut down in order to clear clumps and accumulations.

In order to prevent dust accumulation, dust extraction hoods are typically placed at strategic locations, especially along the "dry" side of the machine. However, these hoods face potential issues. For example, while much of the maculature or detritus is in the form of dust and small particles, larger clumps and pieces of paper can form. For example, because the machine operates at such high speed, breakage of the paper web is not uncommon, and if the web breaks, the shredded tails of the web, and other, larger pieces of paper, can be thrown off at high velocity and drawn into the hoods. These larger clumps can cause a loss of hood efficiency and may require the hood (and potentially also the papermaking machine itself) to be shut down while the blockage is cleared.

SUMMARY OF THE INVENTION

One aspect of the invention relates to a pneumatic hood for a paper—or tissue-making machine. The hood has an elongate inlet that spans almost the entirety of the width of the hood and is thus much wider than it is high. In the hood, an inlet flap is connected by a hinge to the hood body and defines a portion of a face of the hood body and a portion of the inlet. The inlet flap is driven between two positions by a linkage that is actuated by one or more pneumatic cylinder actuators. Thus, the inlet flap can be moved to increase the size of a portion of the inlet in order to clear larger clumps of dust, paper, or other material that may accumulate at the inlet otherwise.

In one embodiment, two linear actuators, such as pneumatic cylinders, are connected to a shaft. Link bars are connected between the shaft and supports on an interior face of the inlet flap. When the pneumatic cylinders are actuated, they pull or push on the shaft, causing the inlet flap to be pivoted between more open and more closed positions.

Other aspects, features, and advantages of the invention will be set forth in the description that follows.

BRIEF DESCRIPTION OF THE DRAWING FIGURES

The invention will be described with respect to the following drawing figures, in which like features are indicated by like numerals throughout the views, and in which.

DETAILED DESCRIPTION

Figure 1:
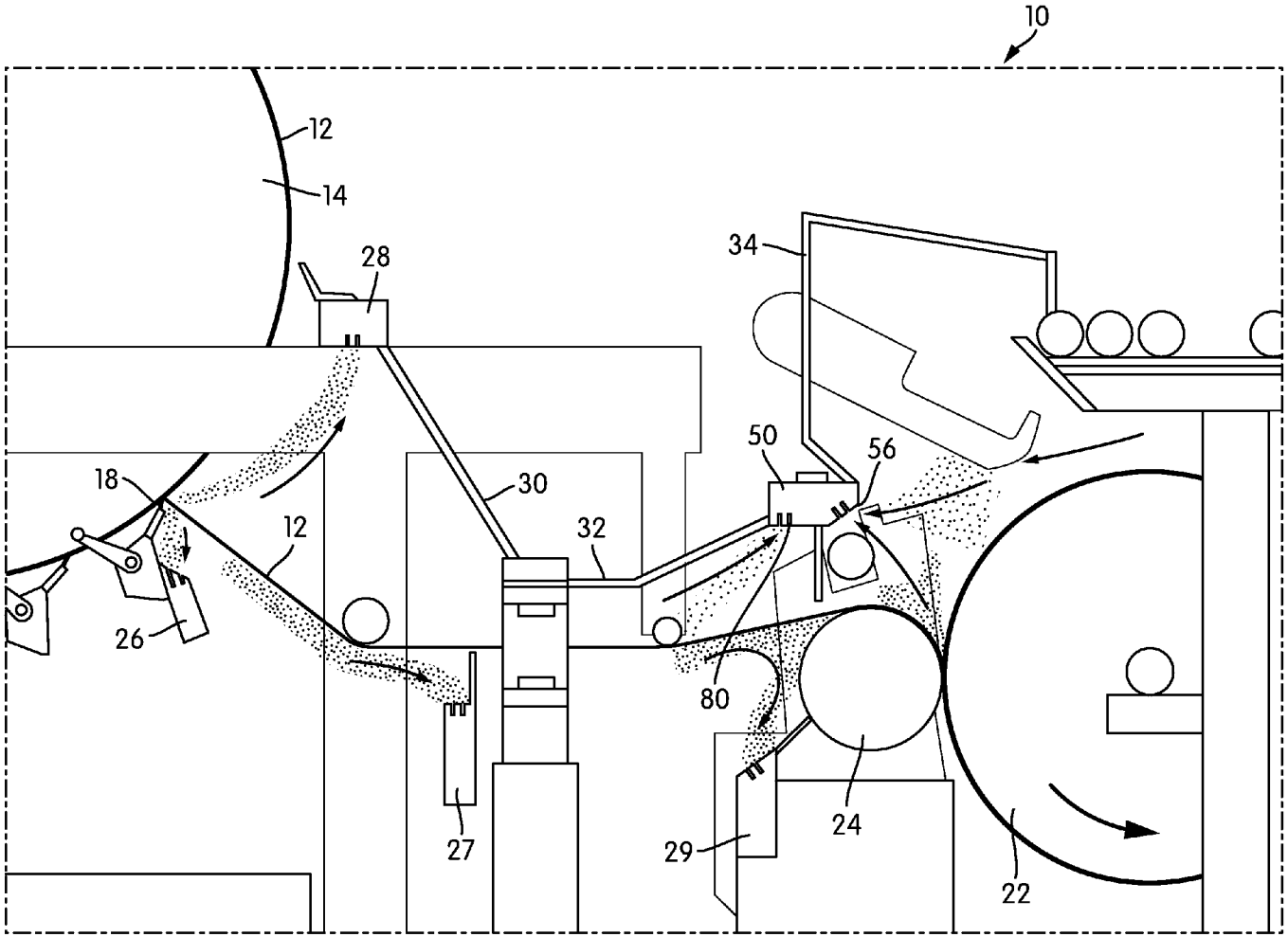
FIG. 1 is a schematic view of the "dry" side of a papermaking machine, showing the installation of one or more pneumatic dust extraction hoods according to embodiments of the invention.

FIG. 1 is a schematic view of the "dry" side of a tissue-making machine or set of machines, generally indicated at 10. A tissue web 12 is wound around a large, heated yankee cylinder 14. The web 12 is removed from the yankee cylinder 14 by a doctor blade 18, is calendered, and is ultimately wound onto a parent roll 22 by a reel drum 24.

For purposes of the present invention, the machine 10 should be considered to be fairly typical, and the precise details of its operation are not critical to the invention. In the illustrated embodiment, a number of pneumatic hoods 26, 27, 28, 29, 50 are positioned along the machine 10 both above and below the web 12 to catch and recover dust. Each hood 26, 27, 28, 29, 50 is connected to a fan or blower and a filtration system (not shown in FIG. 1) that separates the paper dust and fibers from the effluent stream and may, in some cases, return the separated dust and fibers to the "wet" side of the machine for reprocessing. The filter may be, for example, a Venturi scrubber with a tank that holds and wets the captured material for some period of time before returning it to the wet end of the machine 10.

When several hoods 26, 27, 28, 29, 50 are in use, the hoods 26, 27, 28, 29, 50 may be connected to a common fan or blower and a common filtration system, or they may be connected to individual systems. As can be seen in FIG. 1, the hoods 26, 27, 28, 29, 50 are particularly shaped and adapted to operate in specific locations. Aside from different shapes, they may have the same functional features or different functional features.

A series of baffles 30, 32, 34 extend between the components. The baffles 30, 32, 34 help to constrain the dust and direct it into nearby hoods 26, 27, 28, 29, 50. Additionally, when the web 24 breaks, pieces of tissue and the broken tail of the web 12 may be propelled outward at very high velocity. The baffles 30, 32, 34 may also help to prevent severed pieces of the web 12 from posing a safety hazard.

Figure 2:
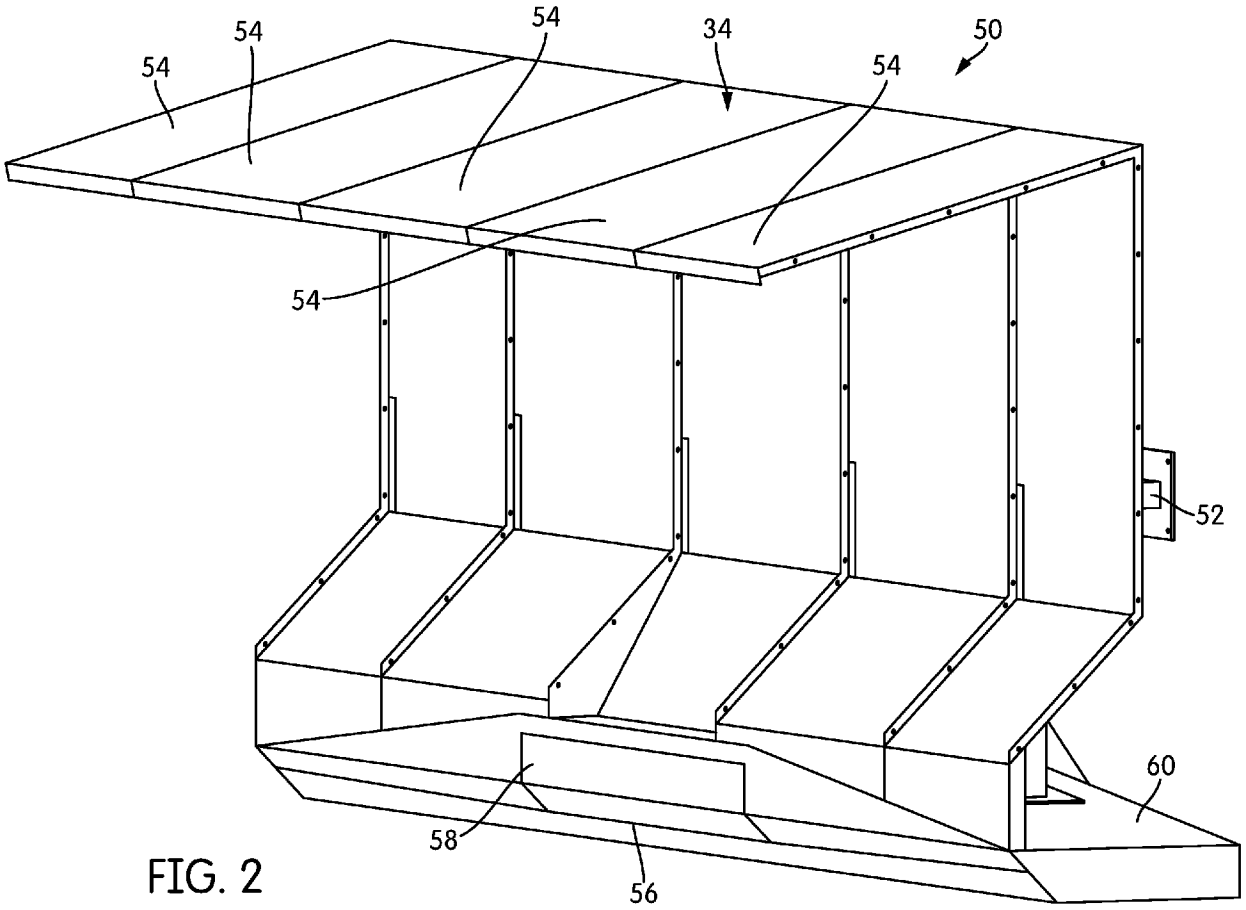
FIG. 2 is a perspective view of the hood of FIG. 1 in isolation.
Figure 3:
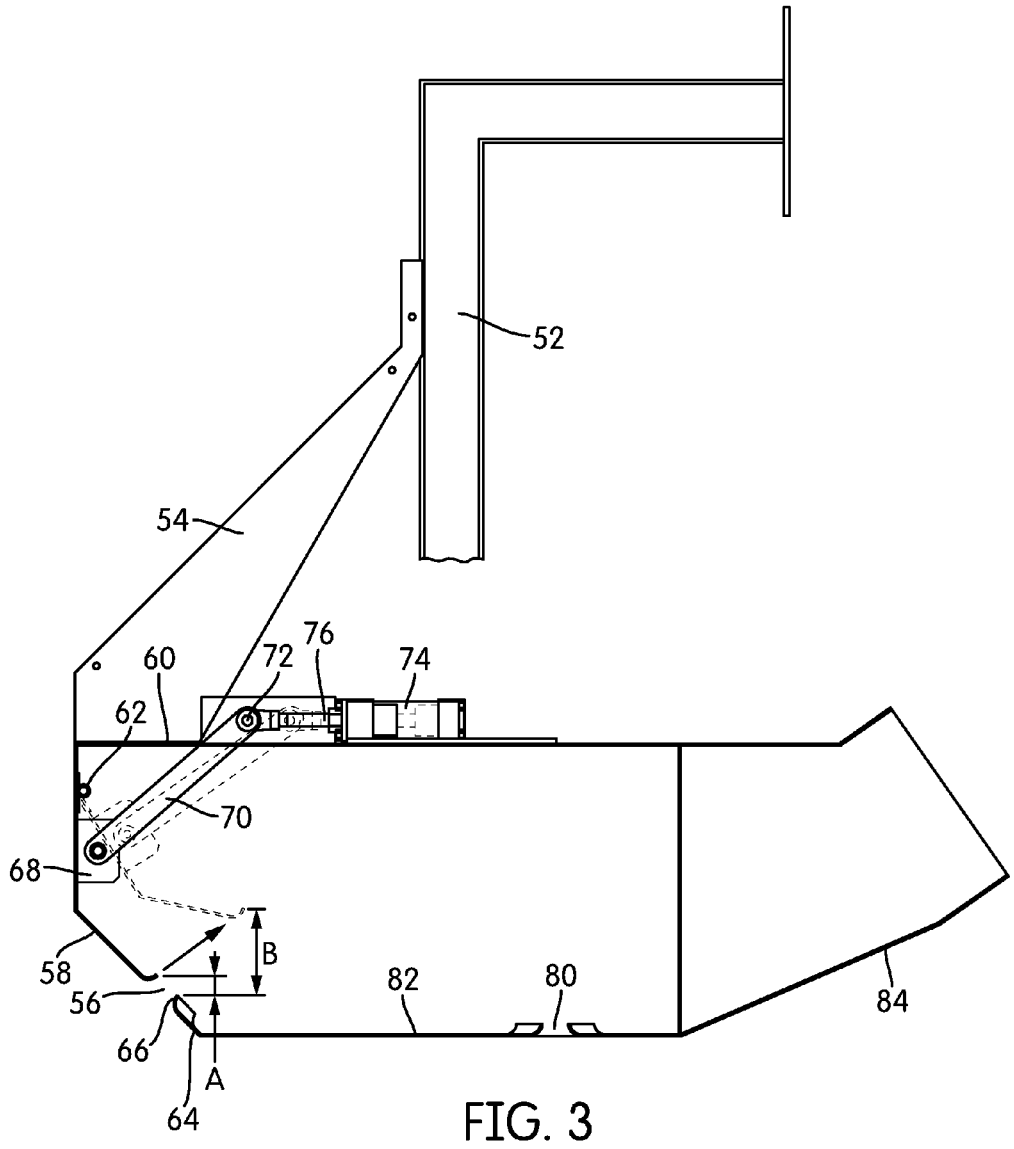
FIG. 3 is a cross-sectional view of the hood, illustrating its movable inlet flap.

FIG. 2 is a perspective view of one of the hoods 50 in isolation, and FIG. 3 is a cross-sectional view of the hood 50. The hood 50 itself would typically extend the full width of the machine 10, which may be, for example, 2.4 or 5.7 meters. Along its width, the hood 50 is supported by multiple brackets 52. As can be seen in FIG. 2, for ease in manufacturing and installation, the baffle 34 that connects to and is contiguous with an upper surface of the hood 50 is comprised of multiple segments 54 that are attached to one another.

Along its front side edge, the hood 50 maintains a small inlet 56, which, in the illustrated embodiment, is in the form of an elongate slit. The inlet 56 is best seen in FIG. 3. The inlet 56 is generally much wider than it is high, for example, on the order of 1.3 inches (3.3 cm) high and 95 inches (2.4 m) in length. The height of the inlet 56 in its usual state is indicated as dimension A in FIG. 3. As shown in FIG. 2, the inlet 56 runs essentially the entire length of the hood—which means that its length may also be on the order of about 2.4 or 5.7 meters. Thus, in this case, "much wider than it is high" refers to inlet dimensions in which the inlet 56 width is more than an order of magnitude greater than the height of the inlet. In the illustrated embodiment, with the width a few meters and the height of the inlet only a few centimeters, the difference between the two is several orders of magnitude. Of course, embodiments of the invention may be implemented with inlets of other dimensions and proportions.

That small inlet height A provides enough space for dust to enter the hood without creating such a large inlet area that the power required to maintain an appropriate pressure drop or draw across the inlet 56 becomes prohibitive. With a relatively small inlet 56, as one example, a 600 hp fan or blower may create a draw of up to 60,000-70,000 cubic feet per minute (up to 2,000 $m^3$/min) across the inlet.

Of course, the inlet 56 need not be of constant height across the entire width of the hood 50. Instead, the inlet 56 may have a varying height, such that, for example, the center of the inlet 56 defines a slightly smaller height than at the sides of the hood body 60—giving the inlet 56 the appearance of an elongate bow tie. For example, the inlet 56 may have a height of about 1 inch (2.54 cm) toward the edges and 0.5 inches (1.3 cm) on center. This has various effects on the flow of air and on pressure and volume of air moving through the inlet 56; however, it also makes it more likely that accumulated dust and clumps will clog the inlet 56 in the portion of lesser height.

In order to deal with the issue of larger clumps of dust and pieces of paper becoming lodged in the inlet 56, at least a portion of the inlet 56 of the hood 50 is of variable size. More particularly, an inlet flap 58 is mounted to the hood body 60 by a hinge 62. The inlet flap 58 itself is a metal plate that extends downwardly from the hinge 62 and is bent, so that the inlet 56 itself is defined on an angle along a lower, sloped face 64 of the hood body 60. The inlet flap 58 makes about a 27-30° bend, although the geometries may vary from embodiment to embodiment in order to place an inlet 56 in proximity to a particular location along a machine 10.

As can be seen in FIG. 3, the inlet flap 58 defines the top of the inlet 56 over approximately the central third of the length of the inlet 56—where most clogging typically occurs, especially if that portion of the inlet 56 has a lesser height. The bottom of the inlet 56 in this embodiment, defined by the edge 66 of the hood body 60 along the sloped face 66, is fixed. The portion of the inlet 56 not defined by the inlet flap 58 is also fixed.

In the illustrated embodiment, only about the central third of the inlet 56 is of variable size because it has been found that, in operation, most clumps and obstructions become lodged along that stretch of the inlet 56, particularly when that portion of the inlet 56 is of lesser height. However, the inlet flap 58 could be of any width, or there could be multiple inlet flaps 58 that cover essentially the entire length of the inlet 56. If there are multiple inlet flaps 58, their movements may be independent or coordinated, so that, in some cases, only the affected portion of the inlet 56 is increased in size to clear an obstruction.

In order to enable the inlet flap 58 to move, the interior face of the inlet flap 58 is connected to a linkage that drives it between a more closed position, defining an inlet 56 with a minimal width, and a more open position, defining an inlet 56 with a greater width. The details of the linkage can be seen in FIG. 3 and in the rear interior elevational view of FIG. 4. Link support blocks 68 are mounted along the inner face of the upper portion of the inlet flap 58. A link bar 70 is rotationally mounted to each link support block 68. The other end of each link bar 70 connects to a shaft 72 that sits above and behind the inlet flap 58.

Pneumatic cylinder actuators 74 are mounted horizontally atop the body 60 of the hood 50 such that they have a forward-rearward stroke (right-left, with respect to the coordinate system of FIG. 3). The rod 76 from each cylinder 74 is connected to the shaft 72. Thus, in this linkage, when the cylinders 74 move the shaft 72 rearwardly from the position illustrated in FIG. 3, the link bars 70 rotate the inlet flap 58 back (counterclockwise, with respect to FIG. 3), and the inlet 56 opens wider. In FIG. 3, this second position of the inlet flap 58 is shown in phantom lines, with the wider opening of the inlet 56 indicated as dimension B. Dimension B, the width of the inlet 56 when the inlet flap is opened, may be on the order of 3-4 inches, e.g., 3.7 inches (9.4 cm).

Figure 4:
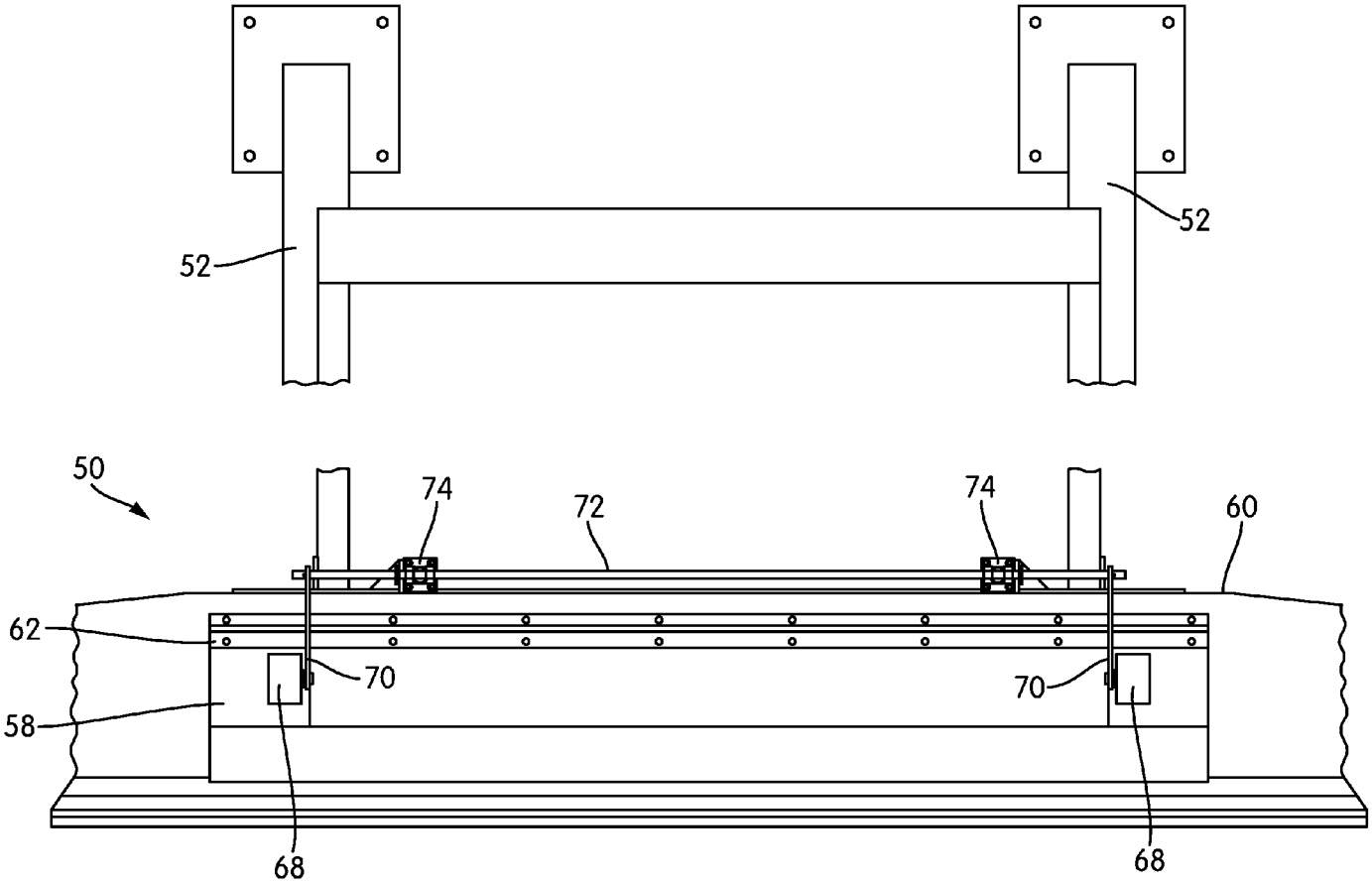
FIG. 4 is a rear interior elevational view of the hood, showing the details of the inlet flap and the linkage that drives it.

In the illustrated embodiment, as can be seen in FIG. 4, There are two pneumatic cylinder actuators 74 spaced from one another along the length of the inlet flap. The link bars 70 are positioned nearly at the ends of the shaft 72, but the cylinders 74 are mounted inwardly of the ends of the shaft 72.

Depending on the size of the hood 50 and the inlet flap 58, the pressure drop across the inlet 56, and a number of other factors, any number of cylinders 74 may be used to drive the inlet flap 58. The shaft 72 ensures that the movements of the two cylinders 74 are coordinated and synchronized. However, in some embodiments, the rods 76 from the cylinders 74 could connect directly to link bars 70 to drive them.

In one embodiment, the cylinders 74 could be, for example, IMI Norgren A-series aluminum cylinders with a 1.5-inch bore and a 2-inch stroke. Of course, while this description focuses on pneumatic cylinders as actuators for the linkage and the inlet flap 58, in some applications, hydraulic cylinders and other forms of linear actuators may be used. In most embodiments, the materials of which the hood 50 is made will be those that can withstand heat and the humidity of drying paper. For example, the hood body 60, inlet flap 58, and other components may be made of 304 stainless steel plating, although aluminum may be suitable in some embodiments.

Dimension B, the height of the inlet opening 56 when the inlet flap 58 is moved to its fully open position, is large enough to accommodate clumps of dust or pieces of paper that might otherwise become lodged in or on the inlet 56 when it is open to its minimal width. Typically, the operator of the hood 50 will seek to maintain it in its small-inlet configuration as much as possible, because, as explained above, a larger inlet requires more power to maintain the same draw. However, dimension B is advantageously not so large as to require prohibitive amounts of power to maintain an appropriate draw or pressure drop when the inlet 56 is fully open. In one embodiment, for example, dimension B may be on the order of 3.7 inches (9.4 cm). Generally speaking, in moving from dimension A to dimension B, the height of the inlet 56 may at least double, and, in the illustrated embodiment, nearly triples. The change in the height of the inlet 56 may vary from embodiment to embodiment, in some cases depending on the average size of maculature, debris, or detritus that is expected. If, in a particular environment, there is a history of larger debris occurring at a particular point along the hood, the maximum opening size of the inlet 56 (and thus, the range of motion of the inlet flap 58) may be increased and, in order to maintain flow, the width of the inlet flap 58 may be decreased. Alternatively, there may be a number of narrower, independently controlled inlet flaps 58 and only the necessary one(s) may be actuated, so that the inlet 56 is only broadened in the necessary region(s).

Of course, while two specific positions of the inlet flap 58 are described here, in some cases, the inlet flap 58 may assume any position between the two extremes. In that case, the inlet flap 58 may be opened just enough to admit a clump and then closed again.

While the linkage and cylinders 74 that actuate the inlet flap 58 may be controlled by an automatic system that triggers when a drop in flow or change in pressure is noted across the inlet 56, in most cases, it will be more advantageous for the position of the inlet flap 58, and thus, the size of the inlet 56, to be controlled manually. With manual control, a human operator can verify the presence of a clog before opening the inlet 56, whereas an automatic system may be prone to false detections.

As shown in FIG. 3, the inlet 56 need not be the only inlet provided in the hood 50. In fact, as will be appreciated from FIG. 1, at least some of the hoods 26, 27, 28, 29, 50 in a typical dust control system for a machine 10 will have more than one inlet, enabling them to accept dust from multiple places or streams. In this case, the hood 50 has a secondary inlet 80 along its bottom face 82. As shown in FIG. 3, the secondary inlet 80 of the illustrated embodiment is an inlet of fixed width, but in other embodiments, the secondary inlet 80 may be equipped with a movable inlet flap or a shutter.

If a single hood 50 has both movable and fixed inlets 56, 80, the decision of which inlets should be fixed and which movable will depend on precisely where the hood 50 is placed, and where breakages in the paper web 12 and/or sources of large clumps or pieces are likely to be located relative to the hood 50. Of course, as those of skill in the art will realize, the size and characteristics of the fan or blower that creates suction may need to be modified in order to provide enough draw for multiple inlets 56, 80.

As is also illustrated in FIG. 3, toward its rear, behind both the variable-area inlet 56 and the secondary, fixed inlet 80, the hood 50 transitions into or connects to ductwork 84, which places it in fluid communication with the fan or blower and the filtration system that draw air through the inlets 56, 80 and recycle any dust or debris that is captured by the hood 50. The hood 50 may transition into or connect with ductwork in any appropriate way, and the ductwork may run the full width of the hood 50 or only a portion of it.

Although hood 50 of FIG. 1 was illustrated as an example of a hood with a movable inlet 56, the other hoods 26, 27, 28, 29 illustrated in FIG. 1 may also be provided with similar features, if necessary or desired. Of course, those hoods 26, 27, 28, 29 may have only fixed inlets in some embodiments.

While the invention has been described with respect to certain embodiments, the embodiments are intended to be exemplary, rather than limiting. Modifications and changes to the invention may be made within the scope of the invention.

What is claimed is:

1. A pneumatic hood, comprising:
- a hood body having an outlet;
- an elongate, open inlet provided in one face of the hood body and extending substantially the entirety of a width of the hood body, the inlet being much wider than it is high;
- an inlet flap hingedly connected to and contiguous with the hood body to define at least a portion of one side of the inlet, the inlet flap being positioned so as to define a central portion of the inlet;
- one or more linear actuators; and
- a linkage connecting the one or more linear actuators to the inlet flap so as to move the inlet flap to selectively and temporarily increase the size of the inlet.

2. The pneumatic hood of claim 1, wherein the one or more linear actuators are pneumatic cylinders.

3. The pneumatic hood of claim 1, further comprising:
- a shaft; and
- two or more link bars rotatably connected between the shaft and the inlet flap;
- wherein the one or more linear actuators drive the shaft between first and second positions.

4. The pneumatic hood of claim 1, wherein the central portion of the inlet has a reduced height relative to edge portions of the inlet.

5. The pneumatic hood of claim 1, wherein the inlet has a width more than an order of magnitude greater than its height.

6. The pneumatic hood of claim 1, further comprising a baffle attached to an upper portion of the hood body.

7. A dust control system, comprising:
- at least two pneumatic dust hoods spaced apart from one another in respective positions to capture dust from an industrial process, at least one of the pneumatic dust hoods including
  - a hood body having an outlet,
  - an elongate, open inlet provided in one face of the hood body and extending substantially the entirety of a width of the hood body, the inlet being much wider than it is high,
  - an inlet flap hingedly connected to and contiguous with the hood body to define at least a portion of one side of the inlet, the inlet flap being positioned so as to define a central portion of the inlet,
  - one or more linear actuators, and
  - a linkage connecting the one or more linear actuators to the inlet flap so as to move the inlet flap to increase or decrease the size of the inlet; and
- a baffle or baffles extending between the at least two pneumatic dust hoods.

8. The dust control system of claim 7, wherein the industrial process comprises paper or tissue manufacture.

9. The dust control system of claim 8, wherein the one or more linear actuators are pneumatic cylinders.

10. The dust control system of claim 8, the at least one of the pneumatic hoods further comprising:

a shaft; and two or more link bars rotatably connected between the shaft and the inlet flap;

wherein the one or more linear actuators drive the shaft between first and second positions.

11. The dust control system of claim 7, wherein the central portion of the inlet has a reduced height compared with side portions of the inlet.

12. The dust control system of claim 8, wherein the baffle or baffles are fixedly attached to the dust hoods.

13. The dust control system of claim 8, wherein the inlet is wider at the sides of the hood than at a central third portion.

14. A pneumatic hood, comprising:

a hood body having an outlet;

an elongate, open inlet provided in one face of the hood body and extending substantially the entirety of a width of the hood body, the inlet being much wider than it is high;

an inlet flap hingedly connected to and contiguous with the hood body to define at least a portion of one side of the inlet, the inlet flap extending over only a portion of the width of the inlet;

one or more linear actuators; and a linkage connecting the one or more linear actuators to the inlet flap so as to move the inlet flap to selectively and temporarily increase the size of the inlet.

15. The pneumatic hood of claim 14, wherein the one or more linear actuators are pneumatic cylinders.

16. The pneumatic hood of claim 14, wherein the inlet flap is actuated by an automated system.

17. The pneumatic hood of claim 14, wherein the inlet flap is controlled manually.

18. The pneumatic hood of claim 14, further comprising:

a shaft; and two or more link bars rotatably connected between the shaft and the inlet flap;

wherein the one or more linear actuators drive the shaft between first and second positions.

* * * * *